US010252091B2

(12) United States Patent
Hariram

(10) Patent No.: US 10,252,091 B2
(45) Date of Patent: Apr. 9, 2019

(54) FIRE-RETAINING CONTAINERS

(71) Applicant: The Boeing Company, Chicago, IL (US)

(72) Inventor: Sham S. Hariram, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 778 days.

(21) Appl. No.: 14/021,690

(22) Filed: Sep. 9, 2013

(65) Prior Publication Data

US 2015/0069069 A1 Mar. 12, 2015

(51) Int. Cl.

| | |
|---|---|
| ***B65D 90/22*** | (2006.01) |
| ***A62C 3/00*** | (2006.01) |
| ***B65D 88/14*** | (2006.01) |
| *A62C 3/08* | (2006.01) |
| *A62C 3/16* | (2006.01) |

(52) U.S. Cl.

CPC ..... *A62C 3/002* (2013.01); *B65D 88/14* (2013.01); *B65D 90/22* (2013.01); *A62C 3/08* (2013.01); *A62C 3/16* (2013.01)

(58) Field of Classification Search

CPC ..... A62C 3/002; B65D 90/22
USPC ..... 220/560.01, 88.1; 109/23, 36
See application file for complete search history.

(56) References Cited

U.S. PATENT DOCUMENTS 4,100,860 A 7/1978 Gablin et al.
4,509,559 A * 4/1985 Cheetham ..... E04B 1/94 138/121
4,714,650 A * 12/1987 Obayashi ..... B32B 25/08 428/365
4,974,739 A * 12/1990 Gelin ..... B65D 90/505 220/567.1
6,349,873 B1 2/2002 Slater
6,670,291 B1 * 12/2003 Tompkins ..... B32B 27/12 428/332
2003/0022115 A1 * 1/2003 Marley ..... F23B 60/00 431/2
2003/0178066 A1 * 9/2003 Skeens ..... B65D 33/1666 137/512.15

(Continued)

FOREIGN PATENT DOCUMENTS

| | | |
|---|---|---|
| CN | 1923637 A | 3/2007 |
| EP | 0520745 A1 | 12/1992 |
| WO | 98/16445 | 4/1998 |

OTHER PUBLICATIONS

"3M NEXTEL Ceramic Woven Tapes 312" Accessed Mar. 28, 2017. http://multimedia.3m.com/mws/media/1256257O/3m-nextel-woven-or-braided-tape.pdf.*

(Continued)

*Primary Examiner* — King M Chu
(74) *Attorney, Agent, or Firm* — Patterson + Sheridan, LLP

(57) ABSTRACT

A fire-retaining container is disclosed which includes a first fire-retarding layer and a second fire-retarding layer connected to the first fire-retarding layer. Another fire-retaining container is disclosed which includes a fire-retarding layer and a reinforcement material reinforcing the fire-retarding layer. A method of containing an item is disclosed. In one step, an item is covered with a fire-retaining container. The fire-retaining container comprises: (1) a first fire-retarding layer and a second fire-retarding layer connected to the first fire-retarding layer; or (2) a fire-retarding layer and a reinforcement material reinforcing the fire-retarding layer.

45 Claims, 5 Drawing Sheets

(56) References Cited

U.S. PATENT DOCUMENTS

2004/0157012 A1* 8/2004 Miller ..... A62C 2/06 428/34.1
2005/0205103 A1* 9/2005 Luedecke ..... A24F 19/00 131/231
2005/0259895 A1* 11/2005 Kozak ..... B65B 31/04 383/61.2
2007/0131684 A1* 6/2007 Cirillo ..... F42B 39/30 220/88.1
2010/0147425 A1* 6/2010 Swain ..... B65D 31/02 150/166
2011/0079456 A1* 4/2011 Borumand ..... A62C 2/06 180/68.5
2012/0048852 A1 3/2012 Knote et al.
2012/0111869 A1* 5/2012 Green ..... B65D 5/606 220/560.01
2012/0145125 A1* 6/2012 McAlister ..... F02M 51/0671 123/445
2013/0161331 A1 6/2013 Pherson
2013/0206759 A1 8/2013 Wurz et al.
2013/0264073 A1 10/2013 Ling
2013/0264346 A1 10/2013 Donahue

OTHER PUBLICATIONS

"Suppress" Definition from Merriam-Webster, Accessed Mar. 29, 2017. https://www.merriam-webster.com/dictionary/suppress.*
European Patent Office, Application No. 14183940.7-1659, search report dated Feb. 11, 2015, pp. 1-6.
Product Bulletin: "Ceramic Textiles and Composites: 3M Nextel 312 Woven Fabrics", 3M Company, 1997.
European Patent Office, Partial European Search Report, Application No. 14183929.0-1659, pp. 1-7, dated Feb. 11, 2015.
Mohammad Al-Zubi, Emmanuel Ayorinde, Akif Dundar and Gary Witus , Acoustic and Vibration Responses of Lexan Plate Constructions, Nov. 2012, ASME 2012 International Mechanical Engineering Congress and Exposition, vol. 8, pp. 297-301 [Abstract Only] [Available Online] http://proceedings.asmedigitalcollection.asme.org/proceeding.aspx?articleid=1751607.

* cited by examiner

FIRE-RETAINING CONTAINERS

FIELD OF THE DISCLOSURE

This disclosure relates to fire-retaining containers for covering or containing an item and retaining or extinguishing a fire started by the item within the fire-retaining container.

BACKGROUND

It is often necessary to transport or store items, which may catch on fire, in containers. These items may comprise electrical and electronic equipment, medical equipment, batteries, computers, tablets, mobile phones, cargo, items disposed on a pallet, or other types of items which may start or catch on fire.

A system and method is needed to provide a fire-retaining container to carry or store items which may start or catch on fire in order to prevent a fire, contain a fire, or retard a fire should one occur.

SUMMARY

In one embodiment, a fire-retaining container is disclosed. The fire-retaining container includes a first fire-retarding layer and a second fire-retarding layer connected to the first fire-retarding layer.

In another embodiment, a fire-retaining container is disclosed. The fire-retaining container includes a fire-retarding layer and a reinforcement material reinforcing the fire-retarding layer.

In still another embodiment, a method of containing an item is disclosed. In one step, an item is covered with a fire-retaining container. The fire-retaining container comprises: (1) a first fire-retarding layer and a second fire-retarding layer connected to the first fire-retarding layer; or (2) a fire-retarding layer and a reinforcement material reinforcing the fire-retarding layer.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
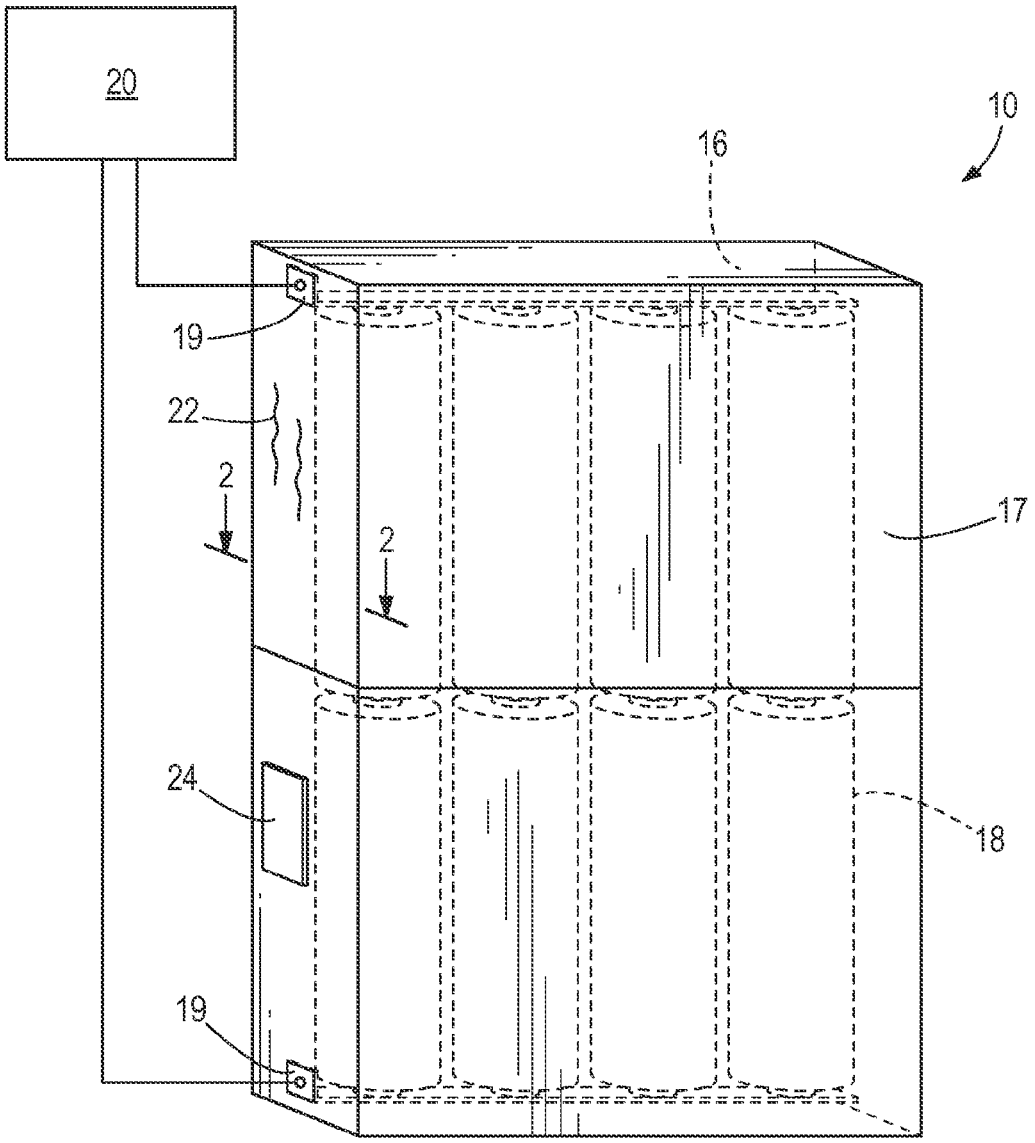
FIG. 1 illustrates a perspective view of a fire-retaining container.
Figure 2:
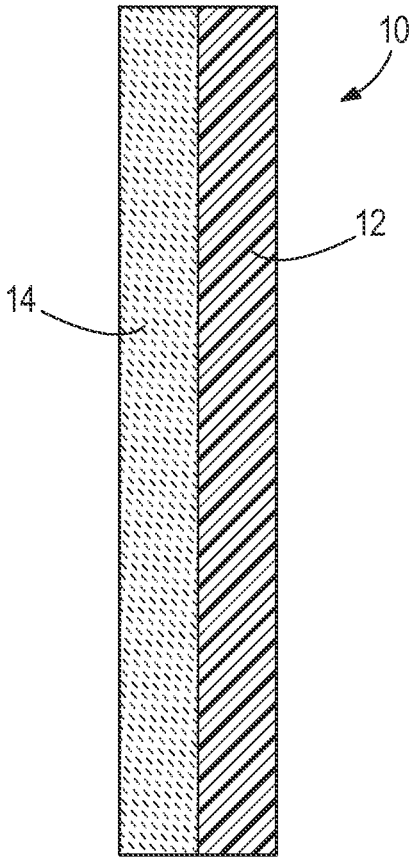
FIG. 2 illustrates a cross-section view through line 2-2 of the fire-retaining container of FIG. 1.

FIG. 1 illustrates a perspective view of a fire-retaining container 10. FIG. 2 illustrates a cross-section view through line 2-2 of the fire-retaining container 10 of FIG. 1. As shown collectively in FIGS. 1-2, the fire-retaining container 10 comprises a first fire-retarding layer 12 and a second fire-retarding layer 14 connected to the first fire-retarding layer 12. The entire fire-retaining container 10 may comprise the same cross-section. In other embodiments, varying portions of the fire-retaining container 10 may vary in cross-section. In another embodiment, the order of the first fire-retarding layer 12 and the second fire-retarding layer 14 may be reversed. In still other embodiments, one or more additional layers or materials may be added.

For purposes of this disclosure, the term 'fire-retarding layer' is defined as a layer that retards fire which doesn't ignite and contains the fire, which prevents the fire from spreading, and which either suppresses the fire or extinguishes it through containment and lack of oxygen. In one embodiment, the first fire-retarding layer 12 comprises poly (4,4'-oxydiphenylene-pyromellitimide). In other embodiments, the first fire-retarding layer 12 may comprise any fire-retarding material having fire retarding properties equivalent to Underwriter Laboratories (UL) Rating of UL-94 V-0 (does not burn) and an operating temperature range of 2450 degrees F. to 3470 degrees F. In still other embodiments, the first fire-retarding layer 12 may vary further. In one embodiment, the second fire-retarding layer 14 comprises ceramic paper having fire retarding properties equivalent to Underwriter Laboratories (UL) Rating of UL-94 V-0 (does not burn) and an operating temperature range of 2450 degrees F. to 3470 degrees F. In other embodiments, the second fire-retarding layer 14 may vary further. Throughout this disclosure, any time the term "fire-retarding" is used or a reference is made to fire-retarding properties, the disclosure of this paragraph applies to the term.

The fire-retaining container 10 comprises a cavity 16 which is configured to contain or hold at least one item 18 which may be a fire hazard. The at least one item 18 may comprise a battery, a lithium battery, an electrical item, cargo, equipment, or another type of item which may be a fire hazard. A door 17 of the fire-retaining container 10 may be moveable to allow the item 18 to be disposed in the cavity 16 of the fire-retaining container 10. The cavity 16 is substantially airtight. For purposes of this disclosure, the term "substantially airtight" is defined as substantially preventing air or gases from going in or out of the cavity 16. In one embodiment, the term "substantially airtight" may comprise preventing 75% to 100% of air or gases from going in or out of the cavity 16. In other embodiments, the substantially airtight cavity 16 may prevent varying levels of air or gases from going in or out of the cavity 16. In one embodiment, the substantially airtight cavity 16 may be under vacuum with a pressure of $1\times10^{-3}$ to $1\times10^{-9}$ Torr or a pressure of $1\times10^{-9}$ to $1\times10^{-7}$ Pa which extinguishes a fire due to lack of air and thus lack of oxygen. In other embodiments, the substantially airtight cavity 16 may be under varying levels of vacuum to make the cavity 16 substantially airtight. Throughout this disclosure, any time the term "substantially airtight" is used or a reference is made to being airtight, the disclosure of this paragraph applies to the term.

The cavity 16 comprises at least one electrical connection 19 which is configured to be connected to the at least one item 18. The electrical connection 19 allows the at least one item 18 to be electrically connected to a device 20 outside of the fire-retaining container 10. The device 20 may comprise any type of device such as a vehicle, an aircraft, a structure, or another type of device. In one embodiment, the electrical connection 19 may allow the item 18 to power the device 20. The fire-retaining container 10 may be sealed with a seal 22 comprising a heat seal, an adhesive seal, a mineral seal, a ceramic seal, a vacuum seal, or another type of seal. The fire-retaining container 10 may comprise a vacuum device 24 which is configured to vacuum air out of the cavity 16 of the fire-retaining container 10.

Figure 3:
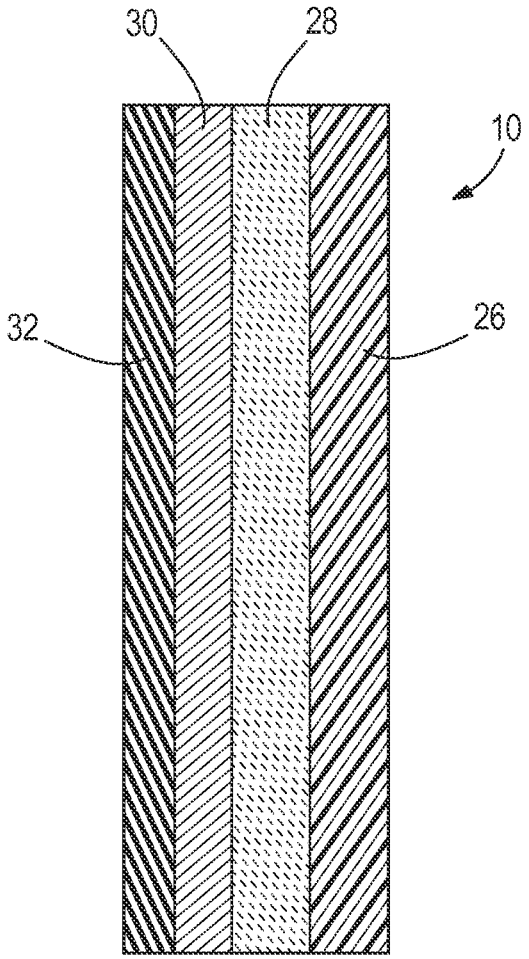
FIG. 3 illustrates another embodiment for the cross-section view through line 2-2 of the fire-retaining container of FIG. 1.

FIG. 3 illustrates another embodiment for the cross-section view through line 2-2 of the fire-retaining container 10 of FIG. 1. The entire fire-retaining container 10 may comprise the same cross-section. In other embodiments, varying portions of the fire-retaining container 10 may vary in cross-section. For this embodiment, the fire-retaining container 10 comprises a first fire-retarding layer 26, a second fire-retarding layer 28, a reinforcement layer 30, and a water-repellant layer 32. For purposes of this disclosure, the term "reinforcement" is defined as providing additional strength to the material(s) being reinforced and preventing the material(s) from tearing or disintegrating. In one embodiment, the reinforcement layer 30 has a fiber density of 2.2 to 2.7 gm/cm 3, a fiber diameter of 9 to 14 micron (Um), and a fiber tensile strength of 1.7 to 5.9 Gpa (Gigapascal) to provide strength to the fire-retaining container 10. In other embodiments, the reinforcement layer 30 may vary. The first fire-retarding layer 26 comprises poly(4,4'-oxydiphenylene-pyromellitimide) or any fire-retarding material. The second fire-retarding layer 28 comprises ceramic paper or any fire-retarding material. The reinforcement layer 30 comprises ceramic, glass, wool, metal, a composite, or another type of reinforcement material. The reinforcement layer 30 may be fire-retarding. Throughout this disclosure, any time the term "reinforcement" is used or a reference is made to reinforcement properties, the disclosure of this paragraph applies to the term.

For purposes of this disclosure, the term "water-repellant" is defined as preventing water from being absorbed by the base material. The water-repellant layer 32 comprises silicone or another type of water-repelling material, coating, or spray. In one embodiment, the water-repellant layer 32 has a water repellency requirement to waterproof test to ASTM D-3393 (2009). In other embodiments, the water-repellant layer 32 may have varying water repellency. In other embodiments, the order of the first fire-retarding layer 26, the second fire-retarding layer 28, the reinforcement layer 30, and the water-repellant layer 32 may be varied, one or more additional layers or materials may be added, or one or more of the layers or materials may not be present. Throughout this disclosure, any time the term "water-repellant" is used or a reference is made to water-repelling properties, the disclosure of this paragraph applies to the term.

Figure 4:
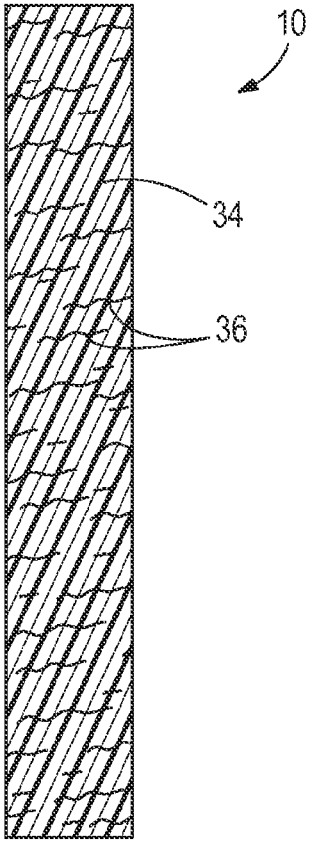
FIG. 4 illustrates another embodiment for the cross-section view through line 2-2 of the fire-retaining container of FIG. 1.

FIG. 4 illustrates another embodiment for the cross-section view through line 2-2 of the fire-retaining container 10 of FIG. 1. The entire fire-retaining container 10 may comprise the same cross-section. In other embodiments, varying portions of the fire-retaining container 10 may vary in cross-section. For this embodiment, the fire-retaining container 10 comprises a fire-retarding layer 34 and a reinforcement material 36 reinforcing the fire-retarding layer 34. The fire-retarding layer 34 comprises poly(4,4'-oxydiphenylene-pyromellitimide) or any fire-retarding material. The reinforcement material 36 adds additional strength to the fire-retarding layer 34 and prevents the fire-retarding layer 34 from tearing or disintegrating. The reinforcement material 36 may have a fiber density of between 2.2 to 2.7 gm/cm 3, a fiber diameter of 9 to 14 micron (Um), and a fiber tensile strength of 1.7 to 5.9 GPa (Gigapascal). In other embodiments, the reinforcement material 36 may vary. The reinforcement material 36 may comprise fibers, metal chards, metal fibers, ceramic, glass, wool, metal, a composite, or another type of reinforcement material that adds to the strength of the fire-retarding layer 34 to prevent it from tearing or disintegrating. The reinforcement material 36 is embedded in the fire-retarding layer 34. The reinforcement material 36 may also be fire-retarding. In other embodiments, the configuration of the fire-retarding layer 34 and the reinforcement material 36 may be varied, one or more additional layers or materials may be added, or one or more of the layers or materials may not be present. Throughout this disclosure, any time the term "reinforcement" is used or a reference is made to reinforcement properties, the disclosure of this paragraph applies to the term.

Figure 5:
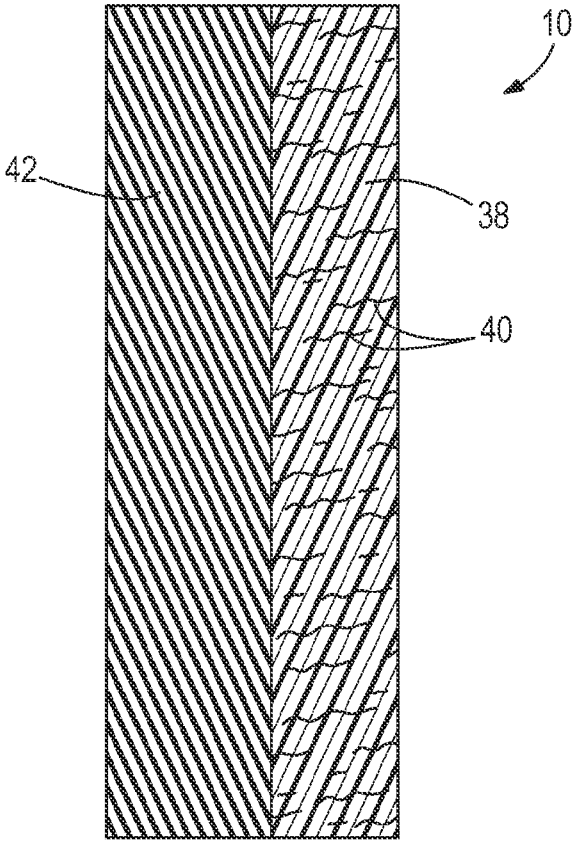
FIG. 5 illustrates another embodiment for the cross-section view through line 2-2 of the fire-retaining container of FIG. 1.

FIG. 5 illustrates another embodiment for the cross-section view through line 2-2 of the fire-retaining container 10 of FIG. 1. The entire fire-retaining container 10 may comprise the same cross-section. In other embodiments, varying portions of the fire-retaining container 10 may vary in cross-section. For this embodiment, the fire-retaining container 10 comprises a fire-retarding layer 38, a reinforcement material 40 reinforcing the fire-retarding layer 38, and a water-repellant layer 42. The fire-retarding layer 38 comprises poly(4,4'-oxydiphenylene-pyromellitimide) or any fire-retarding material. The reinforcement material 40 comprises ceramic, glass, wool, metal, a composite, or another type of reinforcement material. The reinforcement material 40 is embedded in the fire-retarding layer 38. The reinforcement material 40 may also be fire-retarding. The water-repellant layer 42 may comprise silicone or any water-repelling material or coating. In other embodiments, the configuration of the fire-retarding layer 38, the reinforcement material 40, and the water-repellant layer 42 may be varied, one or more additional layers or materials may be added, or one or more of the layers or materials may not be present.

Figure 6:
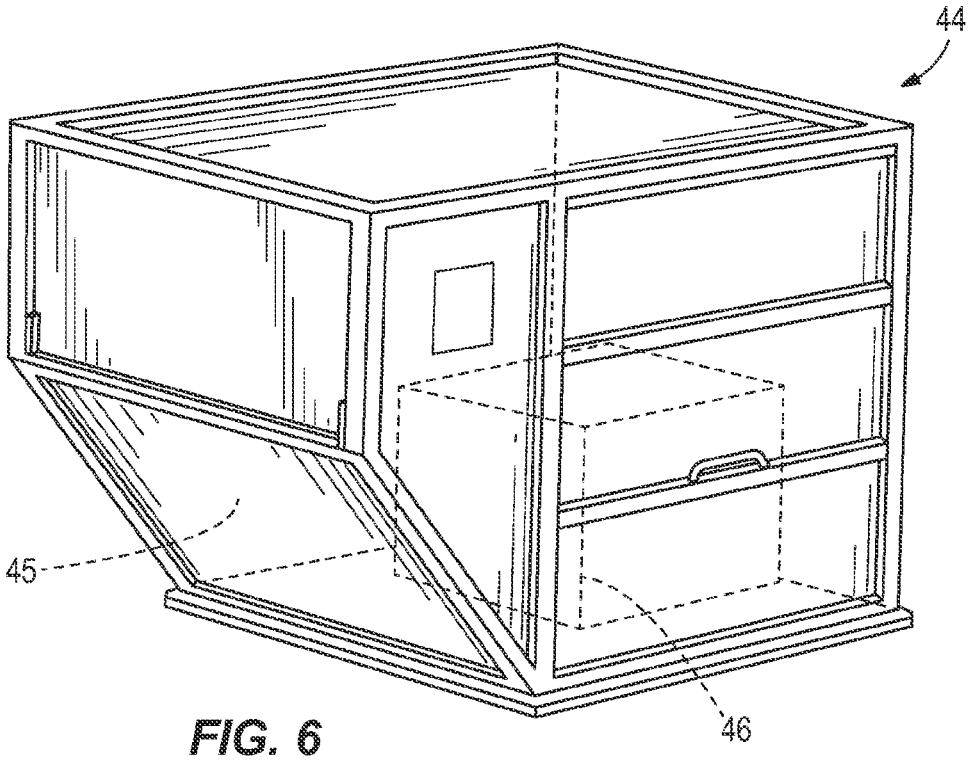
FIG. 6 illustrates a perspective view of another fire-retaining container.

FIG. 6 illustrates a perspective view of another fire-retaining container 44. The fire-retaining container 44 may comprise a cargo container having a cavity 45 for containing or holding cargo 46. The fire-retaining container 44 may be made of the same layers, same materials, and have the same components as any of the embodiments of the fire-retaining container 10 of FIGS. 1-2 including the layer and material embodiments of FIGS. 3-5. In other embodiments, the fire-retaining container 44 may be made of varying layers, varying materials, or varying components.

Figure 7:
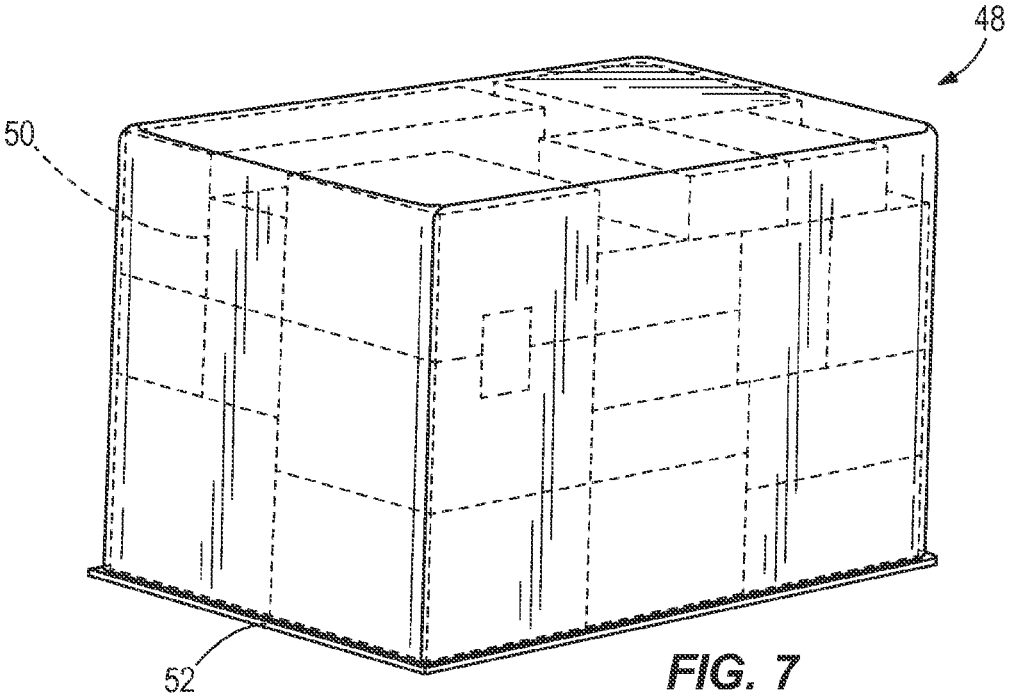
FIG. 7 a perspective view of another fire-retaining container.

FIG. 7 illustrates a perspective view of another fire-retaining container 48. The fire-retaining container 48 may comprise a pallet cover for covering items 50 disposed on a pallet 52. The fire-retaining container 48 may be made of the same layers, same materials, and have the same components as any of the embodiments of the fire-retaining container 10 of FIGS. 1-2 including the layer and material embodiments of FIGS. 3-5. In other embodiments, the fire-retaining container 48 may be made of varying layers, varying materials, or varying components.

Figure 8:
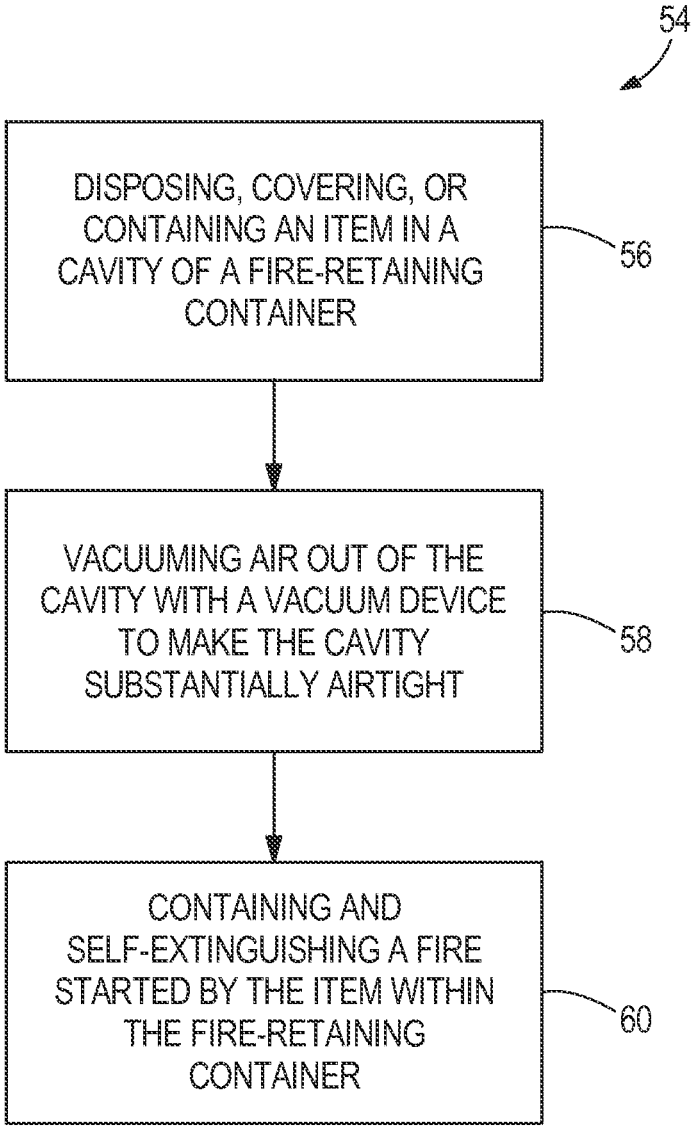
FIG. 8 is a flowchart illustrating one embodiment of a method of containing an item.

FIG. 8 is a flowchart illustrating one embodiment of a method 54 of containing an item. The item may comprise a device which is a fire hazard such as an electrical device, a battery, cargo, an item disposed on a pallet, or another type of device. In step 56, the item is disposed, covered, or contained in a fire-retaining container. In one embodiment, step 56 may comprise disposing the item through a moveable door of the fire-retaining container into a cavity of the fire-retaining container. In step 58, air may be vacuumed out of the cavity with a vacuum device to make the cavity substantially airtight. In step 60, the fire-retaining container may contain a fire started by the item and the fire may self-extinguish itself within the fire-retaining container.

The fire-retaining container may comprise any of the embodiments disclosed herein. The fire-retaining container may comprise a battery fire-retarding container, a cargo container, a pallet cover for covering an item on a pallet, or another type of fire-retaining container. The fire-retaining container may comprise: (1) a first fire-retarding layer and a second fire-retarding layer connected to the first fire-retarding layer; or (2) a fire-retarding layer and a reinforcement material reinforcing the fire-retarding layer. The first fire-retarding layer or the fire-retarding layer may comprise poly(4,4'-oxydiphenylene-pyromellitimide) or other types of fire-retarding materials. The second fire-retarding material may comprise ceramic paper or other types of fire-retarding materials. The reinforcement material may comprise ceramic, glass, wool, metal, a composite, or another type of reinforcement material. The reinforcement material may be embedded in the fire-retarding layer. The reinforcement material may be fire-retarding.

In another embodiment, the fire-retaining container may further comprise a reinforcement layer. The reinforcement layer may comprise ceramic, glass, wool, metal, a composite, or another type of material. The reinforcement layer may further be fire-retarding. In another embodiment, the fire-retaining container may further comprise a water-repellant layer. The water-repellant layer may comprise silicone or another type of material. In other embodiments, the first fire-retarding layer, the second fire-retarding layer, the fire-retarding layer, the reinforcement material, the reinforcement layer, and the water-repellant layer may be made of varying materials, disposed in varying configurations, one or more layers or materials may be missing, or one or more layers or materials may be added.

The fire-retaining container may be sealed with a heat seal, an adhesive seal, a mineral seal, a ceramic seal, a vacuum seal, or with another type of seal. In one embodiment, the fire-retaining container may comprise an electrical connection, and the method may further comprise the step of connecting the electrical connection to the item to power a vehicle, an aircraft, or a structure. In other embodiments, the fire-retaining container may comprise varying components, and the fire-retaining container may be used in varying manners. In still other embodiments, one or more of the steps of the method may be varied in substance or order, one or more steps may not be followed, or one or more additional steps may be added.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. A fire-retaining container comprising:

a first fire-retarding layer;

a second fire-retarding layer connected to the first fire-retarding layer;

a substantially airtight cavity formed by the first fire-retarding layer and the second fire-retarding layer; a reinforcement layer comprising individual fibers, each of the fibers being separated from the other fibers of the reinforcement layer by a portion of the first fire-retarding layer such that the reinforcement layer reinforces the first fire-retarding layer; the first fire-retarding layer comprises poly(4,4'-oxydiphenylene-pyromellitimide); and a vacuum device configured to vacuum air out of the cavity to extinguish a fire.

2. The fire-retaining container of claim 1 wherein the second fire-retarding layer comprises ceramic paper.

3. The fire-retaining container of claim 1 wherein the reinforcement layer comprises ceramic, glass, wool, metal, or a composite.

4. The fire-retaining container of claim 1 further comprising a water-repellant layer.

5. The fire-retaining container of claim 4 wherein the water-repellant layer comprises silicone.

6. The fire-retaining container of claim 4, wherein the water-repellant layer is connected to the reinforcement layer, the reinforcement layer is connected to the second fire-retarding layer, and the second fire-retarding layer is connected to the first fire-retarding layer.

7. The fire-retaining container of claim 1, wherein the cavity is configured to hold at least one electrical item.

8. The fire-retaining container of claim 1 wherein the fire-retaining container comprises a battery fire-retaining container which is configured to hold at least one battery.

9. The fire-retaining container of claim 8 further comprising an electrical connection configured to be connected to the at least one battery.

10. The fire-retaining container of claim 1 wherein the fire-retaining container comprises a cargo container.

11. The fire-retaining container of claim 1 wherein the fire-retaining container comprises a pallet cover.

12. The fire-retaining container of claim 1 wherein the fire-retaining container is sealed.

13. The fire-retaining container of claim 12 wherein the fire-retaining container is sealed with a heat seal, an adhesive seal, a mineral seal, a ceramic seal, or a vacuum seal.

14. The fire retaining container of claim 1, wherein a reinforcement material is disposed within the first fire-retarding layer, and wherein the reinforcement material comprises individual fibers, each of the fibers being separated from the other fibers of the reinforcement material by a portion of the first fire-retarding layer.

15. A method of containing an item comprising:

containing an item with a fire-retaining container, the fire-retaining container comprising a first fire-retarding layer and a second fire-retarding layer connected to the first fire-retarding layer and a substantially airtight cavity formed by the first fire-retarding layer and the second fire-retarding layer; and a reinforcement material comprising individual fibers, each of the fibers being separated from the other fibers of the reinforcement material by a portion of the first fire-retarding layer such that the reinforcement material reinforces the first fire-retarding layer; the second fire-retarding layer comprises poly(4,4'-oxydiphenylene-pyromellitimide)

vacuuming out air from the fire-retaining container to extinguish a fire.

16. A fire-retaining container comprising:

a first fire-retarding layer;

a second fire-retarding layer connected to the first fire-retarding layer; and a reinforcement material comprising individual fibers, each of the fibers being separated from the other fibers of the reinforcement material by a portion of the first fire-retarding layer such that the reinforcement material reinforces the first fire-retarding layer; the first fire-retarding layer comprises poly(4,4'-oxydiphenylene-pyromellitimide).

17. The fire-retaining container of claim 16 wherein the reinforcement material comprises ceramic, glass, wool, metal, or composite.

18. The fire-retaining container of claim 16 wherein the reinforcement material is also fire-retarding.

19. The fire-retaining container of claim 16 further comprising a water-repellant layer.

20. The fire-retaining container of claim 19 wherein the water-repellant layer comprises silicone.

21. The fire-retaining container of claim 16 further comprising a cavity which is configured to hold at least one electrical item.

22. The fire-retaining container of claim 16 wherein the fire-retaining container comprises a battery fire-retaining container which is configured to hold at least one battery.

23. The fire-retaining container of claim 22 further comprising an electrical connection configured to be connected to the at least one battery.

24. The fire-retaining container of claim 16 wherein the fire-retaining container comprises a cargo container.

25. The fire-retaining container of claim 16 wherein the fire-retaining container comprises a pallet cover.

26. The fire-retaining container of claim 16 wherein the fire-retaining container is sealed.

27. The fire-retaining container of claim 16 wherein the fire-retaining container is sealed with a heat seal, an adhesive seal, a mineral seal, a ceramic seal, or a vacuum seal.

28. The fire-retaining container of claim 16 further comprising a vacuum device configured to vacuum air out of the fire-retaining container.

29. The method of claim 15, wherein a reinforcement material is disposed within the first fire-retarding layer, and wherein the reinforcement material comprises individual fibers, each of the fibers being separated from the other fibers of the reinforcement material by a portion of the first fire-retarding layer.

30. The method of claim 15 wherein the item comprises an electrical device.

31. The method of claim 30 wherein the fire-retaining container comprises a battery fire-retarding container and the electrical device comprises at least one battery.

32. The method of claim 31 wherein the fire-retaining container further comprises an electrical connection, and the method further comprises connecting the electrical connection to the at least one battery.

33. The method of claim 15 wherein the fire-retaining container comprises a cargo container and the item comprises cargo.

34. The method of claim 15 wherein the fire-retaining container comprises a pallet cover, and further comprising covering the item disposed on a pallet with the pallet cover.

35. The method of claim 15 wherein the second fire-retarding layer comprises ceramic paper.

36. The method of claim 15 wherein the fire-retaining container further comprises a reinforcement layer.

37. The method of claim 36 wherein the reinforcement layer comprises ceramic, glass, wool, metal, or a composite.

38. The method of claim 15 wherein the fire-retaining container further comprises a water-repellant layer.

39. The method of claim 38 wherein the water-repellant layer comprises a silicone.

40. The method of claim 15 further comprising disposing the item in a cavity of the fire-retaining container.

41. The method of claim 15, wherein the reinforcement material is embedded and contained solely within the first fire-retarding layer, and wherein the reinforcement material comprises ceramic, glass, wool, metal, or composite.

42. The method of claim 29 wherein the reinforcement material is also fire-retarding.

43. The method of claim 15 wherein the fire-retaining container is sealed.

44. The method of claim 43 wherein the fire-retaining container is sealed with a heat seal, an adhesive seal, a mineral seal, a ceramic seal, or a vacuum seal.

45. The method of claim 15 further comprising the fire-retaining container containing a fire started by the item and the fire self-extinguishing within the fire-retaining container.

* * * * *